US009623430B2

(12) United States Patent
Zhang

(10) Patent No.: US 9,623,430 B2
(45) Date of Patent: Apr. 18, 2017

(54) SLIT NOZZLE CLEANING DEVICE FOR COATERS

(71) Applicant: SHENZHEN CHINA STAR OPTOELECTRONICS TECHNOLOGY CO., LTD., Shenzhen, Guangdong (CN)

(72) Inventor: Yueyan Zhang, Guangdong (CN)

(73) Assignee: SHENZEHN CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 14/413,160

(22) PCT Filed: Apr. 10, 2014

(86) PCT No.: PCT/CN2014/075116

§ 371 (c)(1),
(2) Date: Jan. 6, 2015

(87) PCT Pub. No.: WO2015/089961

PCT Pub. Date: Jun. 25, 2015

(65) Prior Publication Data

US 2016/0279656 A1 Sep. 29, 2016

(30) Foreign Application Priority Data

Dec. 20, 2013 (CN) ..... 2013 1 0719683

(51) Int. Cl.
*B05B 15/02* (2006.01)
*B05C 5/02* (2006.01)
(Continued)

(52) U.S. Cl.
CPC ..... *B05B 15/0258* (2013.01); *B05B 15/025* (2013.01); *B05C 5/0254* (2013.01);
(Continued)

(58) Field of Classification Search
CPC . B05B 15/025; B05B 15/0258; B05C 5/0254; B05C 5/0258; B05C 5/0262; B05C 5/0266; B08B 3/08; B08B 15/00
(Continued)

(56) References Cited

U.S. PATENT DOCUMENTS

2004/0213913 A1 10/2004 Jung et al.

FOREIGN PATENT DOCUMENTS

CN 1669680 A 9/2005
CN 101314153 A 12/2008
(Continued)

OTHER PUBLICATIONS

Takagi et al., "JP2005262127A English Machine Translation.pdf", Sep. 29, 2005—Machine translation from Espacenet.com.*
(Continued)

*Primary Examiner* — Michael Barr
*Assistant Examiner* — Levon J Shahinian

(57) ABSTRACT

The present invention discloses a slit nozzle cleaning device for coaters. The slit nozzle cleaning device for coaters comprises a heating source, a crucible and a mixing means, the heating source is used to heat the materials in the crucible; the mixing means is used to mix the materials in the crucible. The mixing means is used to mix the materials in the crucible, thus a uniform heating environment in the crucible can be formed.

13 Claims, 5 Drawing Sheets

(51) Int. Cl.

| | |
|---|---|
| ***B08B 3/08*** | (2006.01) |
| ***B08B 15/00*** | (2006.01) |
| ***B08B 3/02*** | (2006.01) |

(52) U.S. Cl.
CPC ..... *B05C 5/0258* (2013.01); *B05C 5/0262* (2013.01); *B05C 5/0266* (2013.01); *B08B 3/02* (2013.01); *B08B 3/08* (2013.01); *B08B 15/00* (2013.01); *B08B 2203/0229* (2013.01)

(58) Field of Classification Search
USPC ..... 134/104.2, 166 C, 166 R, 167 C, 167 R, 134/169 C, 170, 171
See application file for complete search history.

(56) References Cited

FOREIGN PATENT DOCUMENTS

| | | | |
|---|---|---|---|
| CN | 102161027 | A | 8/2011 |
| CN | 202087472 | U | 12/2011 |
| CN | 103041943 | A | 4/2013 |
| JP | 2005-262127 | A | 9/2005 |
| JP | 2011-167607 | A | 9/2011 |
| JP | 2012135725 | A | 7/2012 |
| JP | 2013192984 | A | 9/2013 |
| KR | 10-2010-0006332 | A | 1/2010 |
| TW | 201210699 | A1 | 3/2012 |

OTHER PUBLICATIONS

Cuihua Cao, the International Searching Authority written comments, Sep. 2014, CN.

* cited by examiner

SLIT NOZZLE CLEANING DEVICE FOR COATERS

FIELD OF THE INVENTION

The present invention pertains to the technical field of linear adhesive coating technology in LCD production, in particular the present invention relates to a slit nozzle cleaning device for coaters.

BACKGROUND OF THE INVENTION

Recently, linear photo resist coater (such as slit nozzle coater) is often used in a photolithography process for manufacturing a semiconductor device such as TFT-LCD modules. In photo resist coating process, photo resist is easy to coagulate. After completion of the photo resist coating, a part of the photo resist remains around the nozzle. When the nozzle tip is not clean, it may seriously affect the product yield. Thus, before the photo resist is coated on the glass substrate, the nozzle will be cleaned, for example by a rubber. However, the rubber has a poor water absorption performance; it cannot remove the photo resist around the nozzle.

SUMMARY OF THE INVENTION

The present invention provides a slit nozzle cleaning device for coaters, which can clean up the photo resist around the opening of the nozzle.

The present invention is realized in such a way that: A slit nozzle cleaning device for coaters, the slit nozzle cleaning device for coaters comprising a cleaner, an adhesive removing dissolvent supply unit and a discharge unit, the cleaner is provided with a groove for engaging with the slit nozzle, the side wall of the groove are provided with adhesive removing dissolvent supply through holes, the adhesive removing dissolvent supply unit is in fluid communication with the adhesive removing dissolvent supply through holes so as to supply adhesive removing dissolvent into the groove, the bottom wall of the groove is provided with discharge holes, the discharge unit is in fluid communication with the discharge holes.

Preferably, both side walls of the groove are provided with multiple adhesive removing dissolvent supply through holes.

Preferably, both side walls of the groove are provided with at least one row of adhesive removing dissolvent supply through holes respectively, the at least one row of adhesive removing dissolvent supply through holes are arranged along the longitudinal direction of the cleaner.

Preferably, the discharge holes are not aligned with the photo resist discharge slit of the slit nozzle in vertical direction.

Preferably, the bottom wall of the groove is provided with one row of discharge holes.

Preferably, the bottom wall of the groove is provided with two rows of discharge holes.

Preferably, there is provided with an engagement gap between the groove of the cleaner and the slit nozzle.

Preferably, there is provided with one row of adhesive removing dissolvent supply through holes along the longitudinal direction of the cleaner.

Preferably, there is provided with two rows of adhesive removing dissolvent supply through holes along the longitudinal direction of the cleaner.

Preferably, the length of the cleaner is equal to the length of the slit nozzle.

Preferably, the cleaner is a cleaner made of rubber.

Preferably, the adhesive removing dissolvent supply unit comprises a pressure tank for receiving adhesive removing dissolvent, the pressure tank is in fluid communication with the adhesive removing dissolvent supply through holes via a pipeline.

Preferably, the discharge unit comprises a vacuum pump, the vacuum pump is in fluid communication with the discharge holes via a pipeline.

Preferably, the discharge unit comprises a waste tank, the vacuum pump is in fluid communication with the waste tank.

According to the present invention, the slit nozzle cleaning device for coaters comprises a cleaner, an adhesive removing dissolvent supply unit and a discharge unit, the cleaner is provided with a groove, the side wall of the groove are provided with adhesive removing dissolvent supply through holes, the bottom wall of the groove is provided with discharge holes, thus the residual photo resist around the nozzle will be dissolved by the adhesive removing dissolvent and discharges via the discharge holes. By this way, the photo resist around the opening of the nozzle can be cleaned up.

For more clearly and easily understanding above content of the present invention, the following text will take a preferred embodiment of the present invention with reference to the accompanying drawings for detail description as follows.

BRIEF DESCRIPTION OF THE DRAWINGS

The drawings described herein are for illustration purposes only and are not intended to limit the scope of the present disclosure in any way.

DETAILED DESCRIPTION OF PREFERRED EMBODIMENTS

The embodiments of the present invention will be described in detail with reference to the accompanying drawings.

Figure 1:
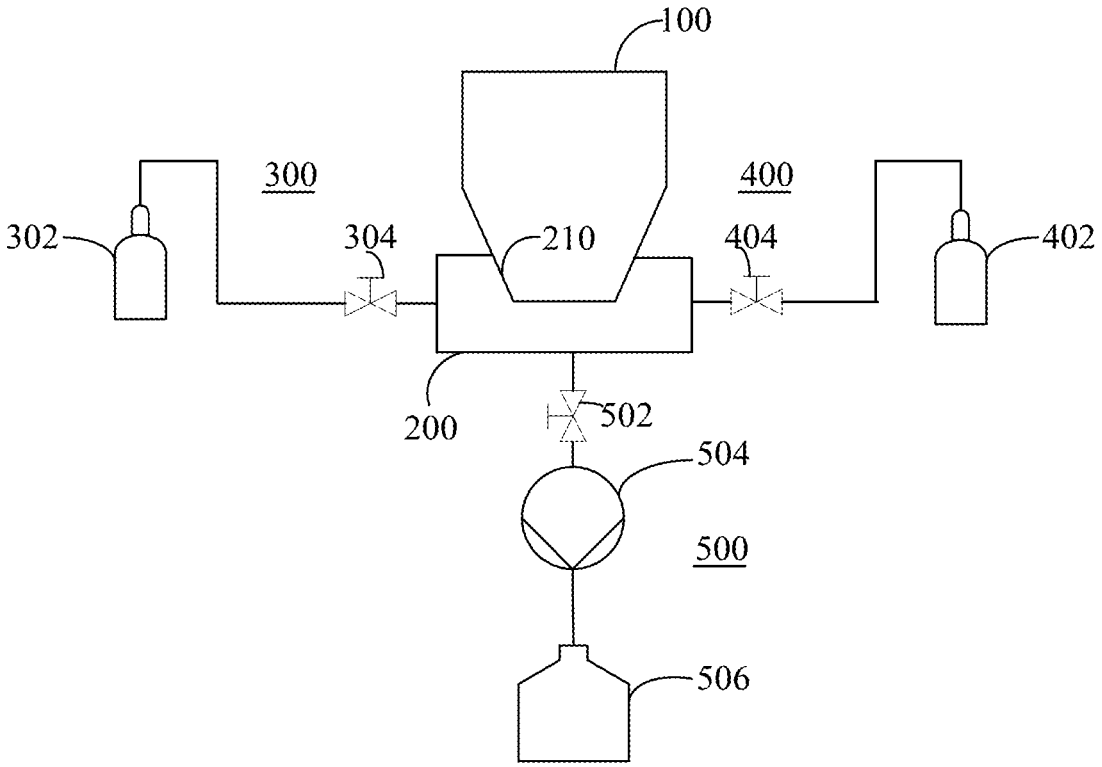
FIG. 1 is a schematic view of the slit nozzle cleaning device for coaters according to an embodiment of the present invention.
Figure 2:
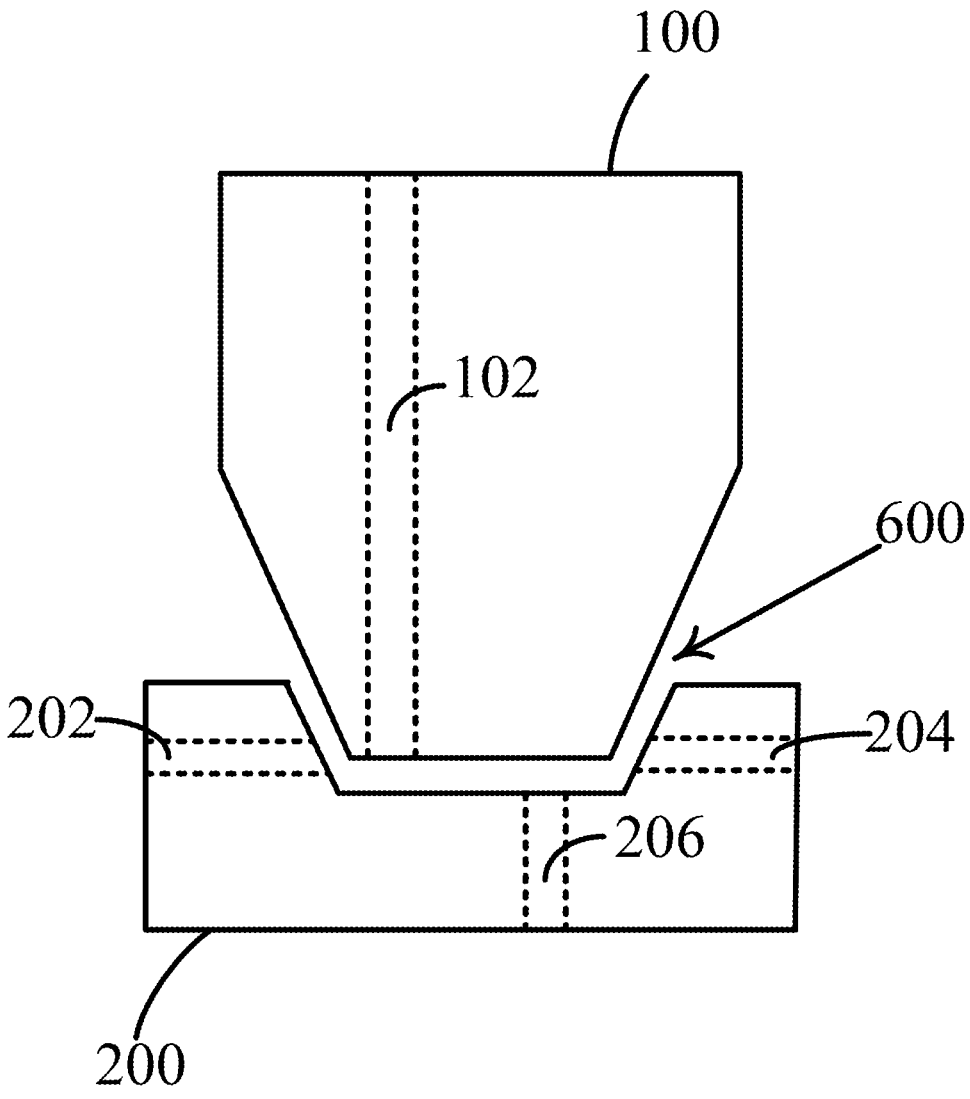
FIG. 2 is a schematic sectional view showing the engaging state of the cleaner of the slit nozzle cleaning device for coaters in FIG. 1 and the slit nozzle.

As shown in FIG. 1 to FIG. 4, in the slit nozzle cleaning device for coaters, both side walls of the cleaner are provided with adhesive removing dissolvent supply through holes 202 and adhesive removing dissolvent supply through holes 204, and the bottom wall of the cleaner is provided with a row of discharge holes 206. The present invention is not limited to the particular embodiment disclosed. For example, in the embodiment illustrated in FIG. 7, the bottom wall of the cleaner is provided with two rows of discharge holes 206. As shown in FIG. 2, there is provided with an engagement gap 600 between the groove 210 of the cleaner 200 and the slit nozzle. By means of the engagement gap 600, the adhesive removing dissolvent supply through holes 202 and adhesive removing dissolvent supply through holes 204 are in fluid communication with the discharge holes 206 to form a purge route. When the coating process of glass substrate is completed, the slit nozzle is back to home point, and the cleaner is raised to engage with the slit nozzle. At this moment, the cleaner is close to the slit nozzle, and there is a gap (i.e. engagement gap 600) between the cleaner 200 and the slit nozzle 100. The adhesive removing dissolvent supply through holes 204 is in fluid communication with the pressure tank 302 for receiving adhesive removing dissolvent via a high pressure pipe line. Adhesive removing dissolvent are injected in the groove, i.e. the side portion of the slit nozzle 100. The residual photo resist around the nozzle will be dissolved by the adhesive removing dissolvent and discharges via the discharge holes. Moreover, the vacuum pump 504 is in fluid communication with the discharge holes 206. By this way, the photo resist around the opening of the nozzle can be cleaned up under the action of the vacuum pump 504.

In addition, the length of the cleaner 200 is equal to the length of the slit nozzle 100. In another embodiment, the length of the cleaner 200 is equal to the width of the glass substrate. By this configuration, when the slit nozzle is back to home point, and the cleaner is raised to engage with the slit nozzle, the cleaning process can be finished in a short time for example in 1 second.

According to the slit nozzle cleaning device for coaters of the present invention, the photo resist around the opening of the nozzle can be cleaned up, the product quality and the product yield can be improved, the cleaning process can be finished in a short time and the tact time of coating process can be shortened.

Figure 7:
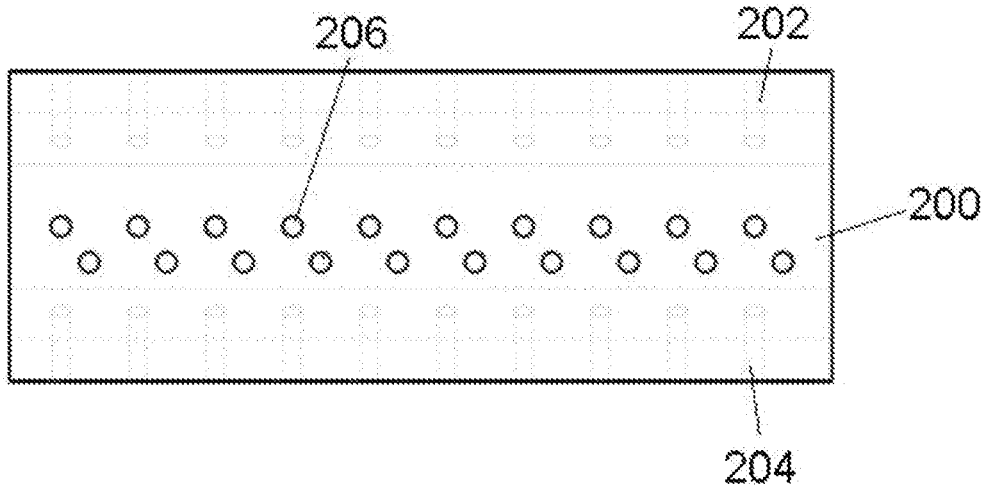
FIG. 7 is a schematic bottom view of cleaner of the slit nozzle cleaning device for coaters according to yet another embodiment of the present invention.

In the embodiment illustrated in FIG. 7, the slit nozzle cleaning device for coaters comprises a cleaner 200, an adhesive removing dissolvent supply unit 300 and a discharge unit 500. The cleaner 200 is provided with a groove 210 for engaging with the slit nozzle. The opening of the slit nozzle 100 is received in the groove 210. The side wall of the groove 210 are provided with adhesive removing dissolvent supply through holes 202. The adhesive removing dissolvent supply unit 300 is in fluid communication with the adhesive removing dissolvent supply through holes 202 so as to supply adhesive removing dissolvent into the groove 210, the bottom wall of the groove 210 is provided with discharge holes 206. The discharge unit 500 is in fluid communication with the discharge holes 206. The above-described adhesive removing dissolvent may be solvent naphtha or orange oil. The above-described adhesive removing dissolvent also may be alcohol.

Figure 3:
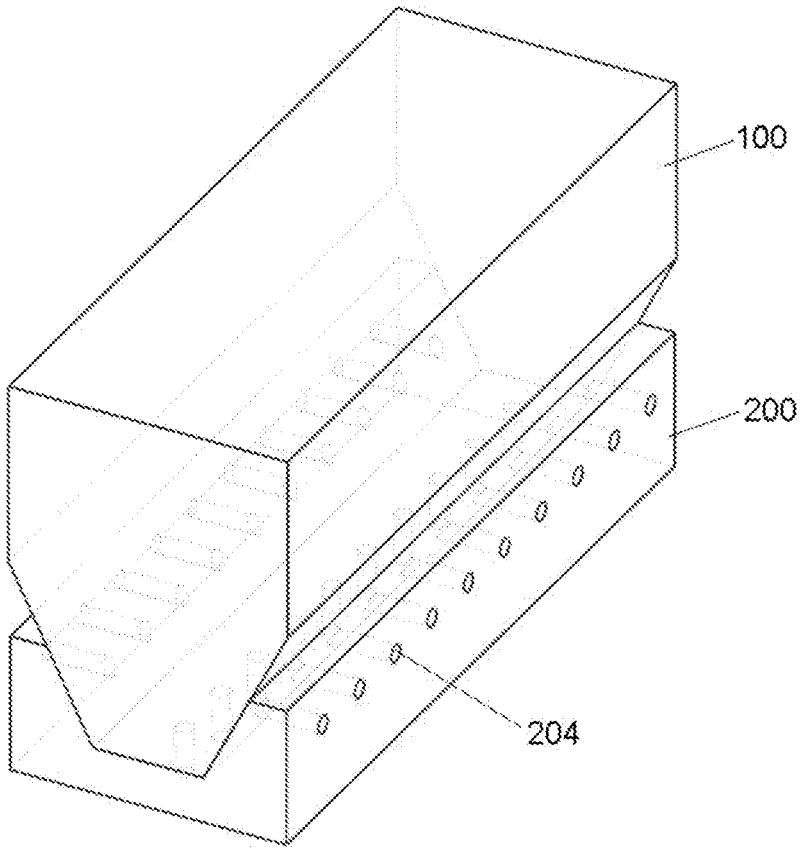
FIG. 3 is another schematic perspective view showing the engaging state of the cleaner of the slit nozzle cleaning device for coaters in FIG. 1 and the slit nozzle.
Figure 4:
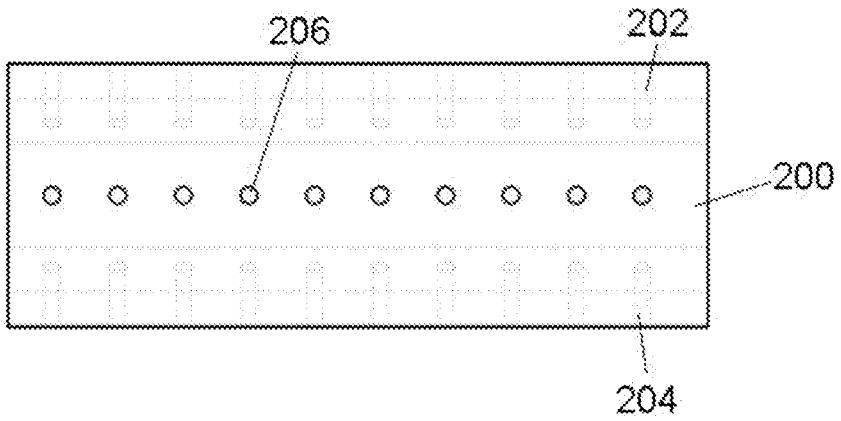
FIG. 4 is a schematic bottom view of cleaner of the slit nozzle cleaning device for coaters in FIG. 1.
Figure 6:
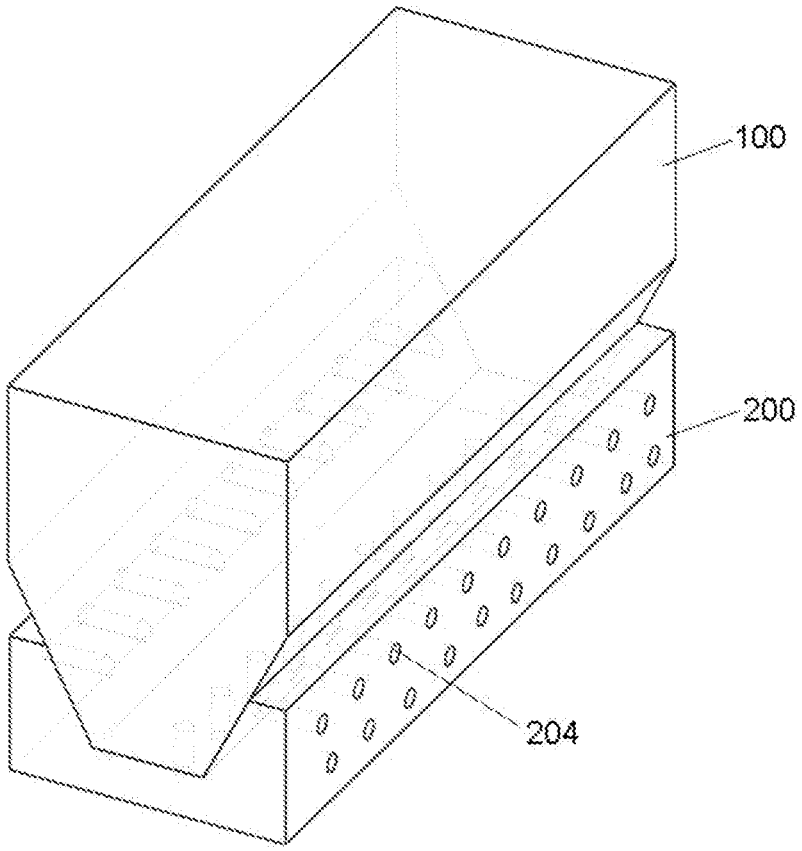
FIG. 6 is a schematic perspective view showing the engaging state of the cleaner of the slit nozzle cleaning device for coaters according to yet another embodiment of the present invention and the slit nozzle.

In the embodiment illustrated in FIG. 1, both side walls of the groove 210 are provided with multiple adhesive removing dissolvent supply through holes. As shown in FIG. 2 to FIG. 4, one side wall of the groove 210 are provided with multiple adhesive removing dissolvent supply through holes 202, the other side wall of the groove 210 are provided with multiple adhesive removing dissolvent supply through holes 204. As shown in FIG. 6, one side wall of the groove 210 are provided with two rows of adhesive removing dissolvent supply through holes 204 respectively, the two rows of adhesive removing dissolvent supply through holes 204 are arranged along the longitudinal direction of the cleaner 200.

As shown in FIG. 2, the discharge holes 206 are not aligned with the photo resist discharge slit 102 of the slit nozzle 100 in vertical direction. In other words, the discharge holes 206 and the photo resist discharge slit 102 of the slit nozzle 100 are not disposed in a straight line. By this way, more residual photo resist around the nozzle will be dissolved by the adhesive removing dissolvent and discharges via the discharge holes.

Preferably, the length of the cleaner 200 is equal to or longer than the length of the slit nozzle 100, so as to shorten the cleaning time. In the present embodiment, the cleaner 200 is a cleaner made of rubber.

Figure 5:
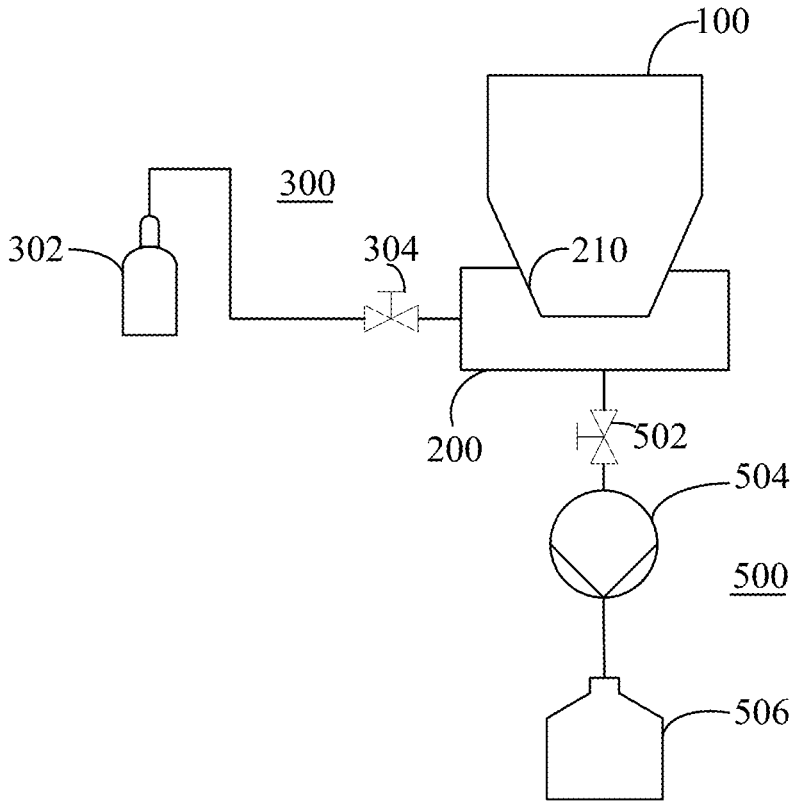
FIG. 5 is a schematic view of the slit nozzle cleaning device for coaters according to another embodiment of the present invention.

As shown in FIG. 1, the adhesive removing dissolvent supply unit 300 comprises a pressure tank 302 for receiving adhesive removing dissolvent; the pressure tank 302 is in fluid communication with the adhesive removing dissolvent supply through holes 202 via a pipeline. A valve 304 is provided between the pressure tank 302 and the adhesive removing dissolvent supply through holes 202. The discharge unit 500 comprises a vacuum pump 504. The vacuum pump 504 is in fluid communication with the discharge holes 206 via a pipeline. A valve 502 is provided between the vacuum pump 504 and discharge holes 206. The discharge unit 500 comprises a waste tank 506, the vacuum pump 504 is in fluid communication with the waste tank 506. By this way, the photo resist dissolved by the adhesive removing dissolvent can be discharged quickly to the waste tank 506. The adhesive removing dissolvent supply unit 400 comprises a pressure tank 402 for receiving adhesive removing dissolvent, the pressure tank 402 is in fluid communication with the adhesive removing dissolvent supply through holes 204 via a pipeline. A valve 404 is provided between the pressure tank 402 and the adhesive removing dissolvent supply through holes 204. Compared with the embodiment illustrated in FIG. 1, in the embodiment illustrated in FIG. 5 the adhesive removing dissolvent supply unit 400 is omitted. The adhesive removing dissolvent supply unit 300 is same with the adhesive removing dissolvent supply unit 400.

According to the present invention, the slit nozzle cleaning device for coaters comprises a cleaner, an adhesive removing dissolvent supply unit and a discharge unit, the cleaner is provided with a groove, the side wall of the groove are provided with adhesive removing dissolvent supply through holes, the bottom wall of the groove is provided with discharge holes, thus the residual photo resist around the nozzle will be dissolved by the adhesive removing dissolvent and discharges via the discharge holes. The photo resist around the opening of the nozzle can be cleaned up, the product quality and the product yield can be improved, the cleaning process can be finished in a short time and the tact time of coating process can be shortened.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A slit nozzle cleaning device for coaters, the slit nozzle cleaning device for coaters comprising a cleaner, an adhesive removing dissolvent supply unit and a discharge unit, wherein the cleaner is provided with a groove for engaging with a slit nozzle, two opposite side walls of the groove are provided with adhesive removing dissolvent supply through holes, the adhesive removing dissolvent supply unit is in fluid communication with the adhesive removing dissolvent supply through holes so as to supply adhesive removing dissolvent into the groove, a bottom wall of the groove is provided with discharge holes, the discharge unit is in fluid communication with the discharge holes, wherein the bottom wall of the groove is provided with one row of discharge holes.

2. The slit nozzle cleaning device for coaters of claim 1, wherein two opposite side walls of the groove are provided with multiple adhesive removing dissolvent supply through holes.

3. The slit nozzle cleaning device for coaters of claim 1, wherein two opposite side walls of the groove are provided with at least one row of adhesive removing dissolvent supply through holes respectively, the at least one row of adhesive removing dissolvent supply through holes are arranged along a longitudinal direction of the cleaner.

4. The slit nozzle cleaning device for coaters of claim 1, wherein the discharge holes are not aligned with a photo resist discharge slit of the slit nozzle in a vertical direction.

5. The slit nozzle cleaning device for coaters of claim 1, wherein the bottom wall of the groove is provided with two rows of discharge holes.

6. The slit nozzle cleaning device for coaters of claim 1, wherein there is provided with an engagement gap between the groove of the cleaner and the slit nozzle.

7. The slit nozzle cleaning device for coaters of claim 1, wherein there is provided with one row of adhesive removing dissolvent supply through holes along a longitudinal direction of the cleaner.

8. The slit nozzle cleaning device for coaters of claim 1, wherein there is provided with two rows of adhesive removing dissolvent supply through holes along a longitudinal direction of cleaner.

9. The slit nozzle cleaning device for coaters of claim 1, wherein a length of the cleaner is equal to a length of the slit nozzle.

10. The slit nozzle cleaning device for coaters of claim 1, wherein the cleaner is a cleaner made of rubber.

11. The slit nozzle cleaning device for coaters of claim 1, wherein the adhesive removing dissolvent supply unit comprises a pressure tank for receiving adhesive removing dissolvent, the pressure tank is in fluid communication with the adhesive removing dissolvent supply through holes via a pipeline.

12. The slit nozzle cleaning device for coaters of claim 11, wherein the discharge unit comprises a vacuum pump, the vacuum pump is in fluid communication with the discharge holes via a pipeline.

13. The slit nozzle cleaning device for coaters of claim 12, wherein the discharge unit comprises a waste tank, the vacuum pump is in fluid communication with the waste tank.

* * * * *